US005561864A

United States Patent [19]

DeMars

[11] Patent Number: 5,561,864

[45] Date of Patent: Oct. 8, 1996

[54] DOLL HEADWEAR

[76] Inventor: Robert A. DeMars, 5000 N. Parkway Calabasas - Ste. 233, Calabasas, Calif. 93102

[21] Appl. No.: 371,800

[22] Filed: Jan. 12, 1995

[51] Int. Cl.[6] ..... A42B 1/24

[52] U.S. Cl. ..... 2/209.13; 446/27; D2/872

[58] Field of Search ..... 2/171, 171.1, 175.1, 2/175.3, 195.1, 195.7, 195.8, 209.11, 209.12, 209.13, 244, 422, 909, 918; 446/27, 73; D2/865, 866, 868, 869, 870, 871, 872, 873, 874, 895

[56] References Cited

U.S. PATENT DOCUMENTS

D. 174,517 4/1955 Schwartz ..... D2/872

D. 216,769 3/1970 Hicks ..... D2/872

4,543,669 10/1985 Katz ..... 2/84

5,393,257 2/1995 Spector ..... 446/27

*Primary Examiner*—Diana Biefeld

*Attorney, Agent, or Firm*—Jack C. Munro

[57] ABSTRACT

A form of headwear that is adapted to be worn by a human, generally a child, generally in the form of a cap or visor. Mounted on the frontal section of the cap is the first type of engagable fastener. A doll, which has arms, hands, legs and feet has a second type of engagable fastener mounted on each hand. Connecting of the second type of engagable fastener with the first type of engagable fastener will position the doll about the head of the child with the legs resting on the shoulders of the child.

3 Claims, 1 Drawing Sheet

DOLL HEADWEAR

BACKGROUND OF THE INVENTION

1. Field of the Invention

The field of this invention relates to entertainment devices and more particularly to a doll that is designed to be worn in an unattended manner in conjunction with headwear that is to be worn by a child.

2. Description of the Prior Art

Different types of entertaining hats to be worn by humans have long been known. One example of such a hat would be what is referred to as a propeller type of beanie which in the past has been worn by children.

It is also known that young children have an attraction to dolls and specifically dolls that represent figures that are attractive to children. An example of such attractive figures would be Mickey Mouse, Minnie Mouse, Pluto and other such figures. In the past hats have been designed with representation of such figures which are desirably worn by children. However, it has not been known by applicant in the past to actually incorporate a doll in conjunction with headwear with the doll being worn by the human child.

SUMMARY OF THE INVENTION

Headwear in the form of a cap or visor where the cap or visor includes a first type of engagable fastener on the frontal section of the cap or visor. The frontal section is defined as the portion of the headwear that would be in substantial alignment with the forehead and face of the user. A doll is utilized that has a pair of arms which terminate in hands and a pair of legs which terminate in feet. Included on the hands of the doll is a second type of engagable fastener. When the second type of engagable fastener is engaged with the first type of engagable fastener, the doll is now secured to the headwear with the legs of the doll resting on the shoulders of the child. The feet are to be weighted so that the feet and legs tend to maintain their established position resting on the shoulders.

The primary objective of the present invention is to construct a combination doll and headwear that is attractive to a child when it is worn.

Another objective of the present invention is to construct a doll headwear that is composed of few parts and is non-complex, and therefore it can be manufactured at a reasonable cost and therefore sold to the ultimate consumer at a reasonable cost.

DETAILED DESCRIPTION OF THE SHOWN EMBODIMENT

Figure 1:
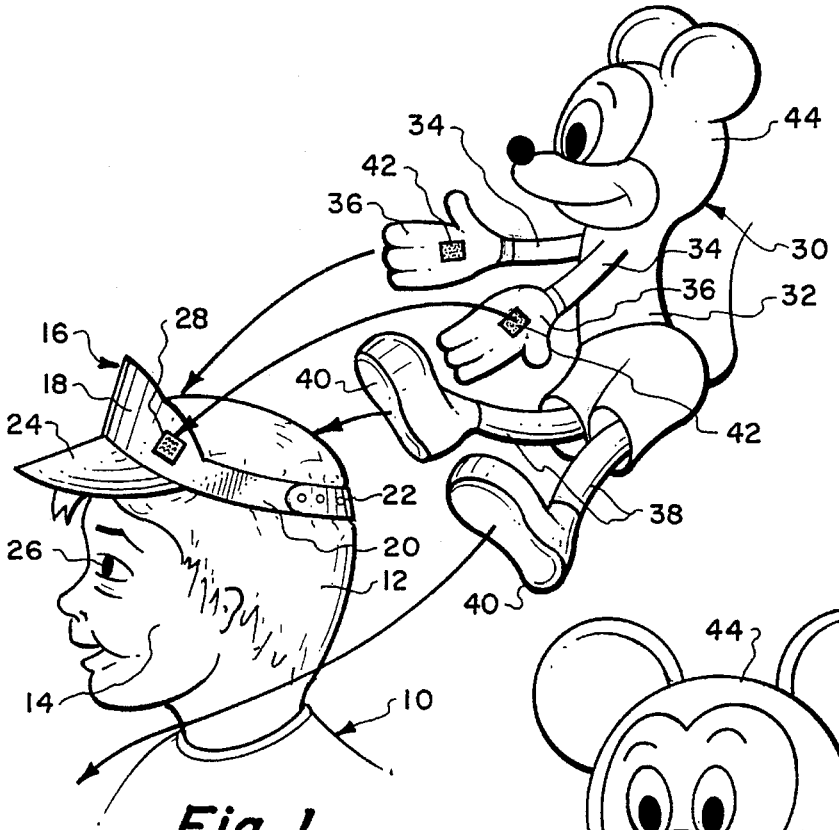
FIG. 1 is a side elevational view showing a child wearing the headwear of the present invention and depicting the installation of the doll with the headwear.

Referring particularly to the drawing there is shown a child 10 having a head 12 and a face 14. Mounted on the head 12 is the headwear 16 of this invention. The headwear

16 happens to be shown as a visor which has a frontal section 18 and a band 20 which is to extend around the back of the head 12. The band 20 will normally include some form of adjustment device 22 so as to accommodate to different sizes of heads 12. The visor 16 includes a brim 24, the function of which is to normally shield the eyes 26 of the human child 10 from the sun. It is to be understood that instead of a visor, a cap may be used.

Mounted on the front section 18 are a pair of fasteners 28 with only one such fastener 28 being shown. Generally one fastener 28 will be located on the left side of the frontal section 18 with the other fastener 28 being located on the right side of the frontal section 18. A typical type of fastener that could be used for the fastener 28 would be what is commonly sold under the tradename of VELCRO. The fastener 28 can comprise a pad of a mass of tiny eyelets.

There is also to be used a doll 30 which includes a torso 32. Extending from the torso 32 are arms 34 which terminates in hands 36. Also extending from the torso 32 are legs 38 and feet 40. On the outer surface of the hands 36 are located a second type of releasable fastener 42 with it being understood that there is a single fastener 42 located on each hand 36. A desirable form for the releasable fastener 42 would be what is again commonly sold under the tradename of VELCRO and can comprise a pad composed of a mass of tiny hooks. When the tiny hooks are connected with the tiny eyelets, a secure connection is formed therebetween. However, upon application of sufficient manual outward force to each of the hands 36, each of the hands 36 will appropriately disengage from the front section 18.

Figure 2:
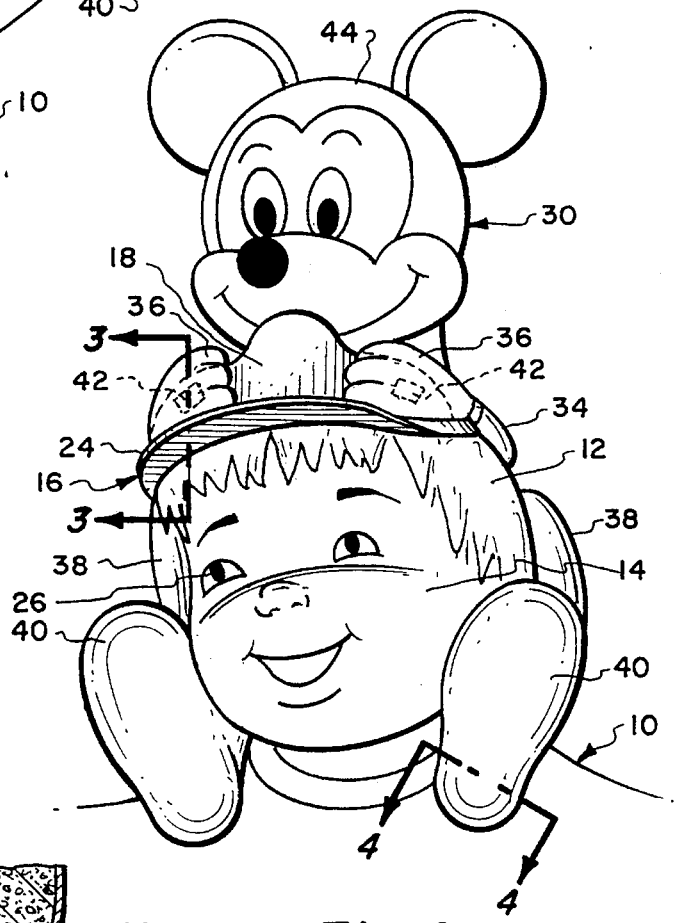
FIG. 2 is a front elevational view of a child who is wearing the doll headwear of the present invention.
Figure 3:
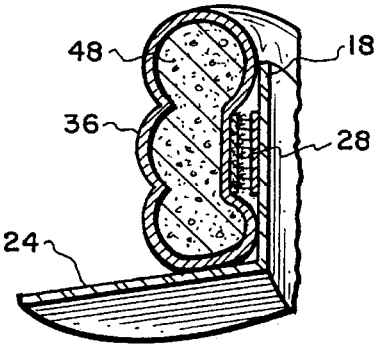
FIG. 3 is a cross-sectional view through one of the hands of the doll that are connected to the headwear taken along line 3—3 of FIG. 2.
Figure 4:
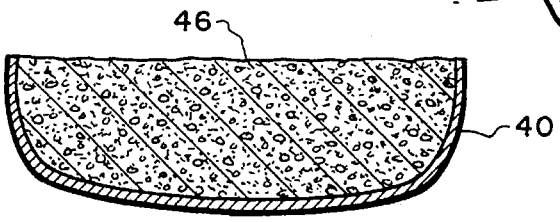
FIG. 4 is a cross-sectional view through one of the feet of the doll taken along line 4—4 of FIG. 2.

When each of the fasteners 42 are connected with the respective fastener 28, the doll 30 will be wrapped about the head 12 of the child with the head 44 of the doll being readily observable in a frontal view of the child 10. This appearance is readily observed in FIG. 2. For young children this is an attractive appearance and is generally enjoyed by most children.

When the fasteners 42 are engaged with the fasteners 28, each leg 38 is to rest on a shoulder of the child 10. This in turn will position the feet 40 directly adjacent the face 14 of the child. In order to assist in having the legs 38 and the feet 40 maintain this position when the doll 30 is connected to the headgear 16, it is desirable to slightly weight the feet 40. This weighting can be obtained by filling the feet 40 with a dense wadding 46. Generally the wadding 46 will be constructed of a cotton or other similar type of natural material that is non-toxic and cannot be harmful to the child 10.

Each of the hands are formed similar to the feet 40 in that they include an outer layer of fabric material which encases a wadding 48. However, the wadding 48, though similar to wadding 46, need not be as dense and therefore not as heavy as the wadding 46 of the feet 40.

What is claimed is:

1. Doll headwear comprising:

headwear adapted to be worn by a human which has a head extending above shoulders, said headwear having a first type of engagable fastener; and a doll having a pair of arms and a pair of legs each of which extend from a torso, each said arm terminating in a hand, each said leg terminating in a foot, each said hand having a second type of engagable fastener, each said second type of engagable fastener to releasably connect with a said first type of engagable fastener forming a secure connection therebetween thereby locating said doll about the head of a human with said legs resting on the shoulders of a human when the headwear is worn by the human, said doll being separate from said headwear.

2. The doll headwear as defined in claim 1:

said headwear having a frontal section, said frontal section being located substantially in alignment with the face of a human, said first type of engagable fastener being located on said frontal section when the headwear is worn by the human.

3. Doll headwear comprising:

headwear adapted to be worn by a human which has a head extending above shoulders, said headwear having a first type of engagable fastener;

a doll having a pair of arms and a pair of legs each of which extend from a torso, each said arm terminating in a hand, each said leg terminating in a foot, each said hand having a second type of engagable fastener, each said second type of engagable fastener to releasably connect with a said first type of engagable fastener forming a secure connection therebetween thereby locating said doll about the head of a human with said legs resting on the shoulders of a human when the headwear is worn by the human, said doll being separate from said headwear; and each said foot being weighted to cause each said foot to be abnormally heavy when compared to the remainder of said doll, whereby the weighting of the feet tends to maintain said legs in a resting position on the shoulders of a human when the headwear is worn by the human.

* * * * *